US007114266B2

(12) United States Patent
Gomes et al.

(10) Patent No.: US 7,114,266 B2
(45) **Date of Patent: *Oct. 3, 2006**

(54) APPARATUS AND METHOD FOR MOISTURE CONTROL

(75) Inventors: Francis Gomes, Jersey City, NJ (US); Paul Thom, Butler, NJ (US); David Landsberger, Caldwell, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/883,053

(22) Filed: Jul. 1, 2004

(65) Prior Publication Data

US 2004/0237333 A1 Dec. 2, 2004

Related U.S. Application Data

(63) Continuation-in-part of application No. 10/287,219, filed on Nov. 4, 2002, now Pat. No. 6,772,534.

(60) Provisional application No. 60/364,823, filed on Mar. 15, 2002.

(51) Int. Cl.

| | |
|---|---|
| ***F26B 3/00*** | (2006.01) |
| ***F25D 23/00*** | (2006.01) |
| ***F25D 17/06*** | (2006.01) |
| *F26D 21/06* | (2006.01) |

(52) U.S. Cl. ..... 34/80; 34/210; 34/594; 62/92; 62/93; 62/94; 62/271

(58) Field of Classification Search ..... 34/80, 34/210, 330, 343, 472, 528, 594; 62/92, 62/93, 94, 271; 96/127, 130, 140, 141, 142, 96/144, 154; 95/119, 120, 121

See application file for complete search history.

(56) References Cited

U.S. PATENT DOCUMENTS

| | | | | |
|---|---|---|---|---|
| 2,949,014 | A | 8/1960 | Belton, Jr. et al. | |
| 4,022,560 | A * | 5/1977 | Heinonen | 425/317 |
| 4,361,425 | A | 11/1982 | Hata | |
| 4,536,198 | A | 8/1985 | Strain | |
| 4,654,057 | A | 3/1987 | Rhodes | |
| 4,700,550 | A | 10/1987 | Rhodes | |
| 5,230,719 | A | 7/1993 | Berner et al. | |
| 5,297,398 | A | 3/1994 | Meckler | |
| 5,373,704 | A | 12/1994 | McFadden | |
| 5,661,983 | A | 9/1997 | Groten et al. | |
| 5,799,728 | A | 9/1998 | Blume | |
| 5,817,167 | A | 10/1998 | DesChamps | |
| 6,364,942 | B1 | 4/2002 | Felber et al. | |
| 6,379,435 | B1 | 4/2002 | Fukunaga et al. | |
| 6,772,534 | B1 * | 8/2004 | Gomes et al. | 34/330 |

OTHER PUBLICATIONS

Bel-Art Products, Inc catalog 198 pp. 98-112 (1998).

* cited by examiner

*Primary Examiner*—Jiping Lu
(74) *Attorney, Agent, or Firm*—Lawrence G. Fridman, Esq.

(57) ABSTRACT

A housing assembly includes first and second sides and first and second panels spaced apart from each other by an interior of the housing and traversing the first and second sides. A first porous desiccant retention plate and a second porous desiccant retention plate are spaced from each other are secured within the housing so as to define a desiccant chamber therebetween for maintaining the desiccant medium. An opening is formed within one of said panels in a location corresponding to the location of the desiccant chamber, facilitating replacement of the desiccant medium within the desiccant chamber.

12 Claims, 9 Drawing Sheets

APPARATUS AND METHOD FOR MOISTURE CONTROL

This is a continuation-in-part application of U.S. patent application Ser. No. 10/287,219 filed Nov. 4, 2002, now U.S. Pat. No. 6,772,534, which is currently pending, and which claims benefit under 35 USC 119(e) of U.S. provisional application Ser. No. 60/364,823 filed on Mar. 15, 2002 by Francis Gomes, Paul Thom and David Landsberger.

FIELD OF THE INVENTION

The present invention relates generally to arrangements adapted for removing moisture, and more specifically, it relates to a method and apparatus for removing moisture from interior spaces.

DESCRIPTION OF THE PRIOR ART

Arrangements for removing moisture from enclosures or interior spaces are widely used in industries in which products stored in the enclosed or interior spaces must be maintained at a sufficiently low moisture level or content to preserve their functional integrity. The ability to maintain reduced moisture levels is particularly critical in laboratory cabinets and related storage enclosures, since such enclosures are commonly used to store chemicals, materials, products and equipment particularly susceptible to moisture damage. For example, elevated moisture levels within laboratory cabinets can cause contamination of chemicals, materials and other substances stored therein. In similar fashion, the precision and functionality of chemical handling and measurement equipment can often be undesirably compromised by such exposure.

Conventional dehumidifying arrangements include a blowing mechanism, such as a rotating fan, positioned within a housing and functioning to draw a flow of moisture-filled air into at one end of a housing and through a desiccant medium, with the moisture transferred to the desiccant medium and the dried air emerging from an opposite end of the housing. Periodically, the desiccant medium in such conventional apparatus becomes saturated with moisture, requiring either replacement or regeneration of the desiccant for subsequent drying of the air in the enclosure. In the latter instance, desiccant drying can be accomplished by facilitating a reverse flow of heated air through the desiccant to remove the moisture from, and thereby regenerate the desiccant. For laboratory cabinet applications, it would be desirable to have such an apparatus separate the flow path of the cabinet drying air from the flow path of the desiccant regenerating air such that the undesirable flow of moist regeneration air from the desiccant back into the enclosed cabinet space is avoided.

Moisture removing and controlling apparatus are known in the prior art. However, these known moisture-removing devices generally suffer from one or more drawbacks and limitations which render them undesirable for the aforementioned laboratory cabinet applications. For example, U.S. Pat. No. 4,361,425 discloses a dehumidifier having a moisture-collecting chamber which contains a loose or preformed solid desiccant. The chamber is connected to a conventional drain valve that operates automatically periodically for draining the moisture from the chamber. A high-speed fan is installed adjacent to the chamber for subjecting compressed air passing therethrough to centrifugal force, thereby removing moisture and foreign particles from the compressed air. Accordingly, the dehumidifier disclosed in the '425 patent is specifically designed for removing moisture from compressed air rather than from air generally confined in an interior space. Moreover, the design requirements of the particular application do not permit self-regeneration of the desiccant, which must be periodically removed from the moisture-collecting chamber and replaced. U.S. Pat. Nos. 4,654,057 and 5,230,719 are exemplary of other types of known moisture removal, or dehumidifying, apparatus. However, these disclosed exemplary devices draw the moist air to be dried into one end of a housing and discharge the dried air from the opposite end of the housing. Regeneration or drying of the desiccant requires reverse flow of air through the housing, discharging moist regeneration air back into the space from which moisture was removed during the drying step. Obviously such operational principle is unacceptable for the highly humidity sensitive environment of the laboratory equipment. U.S. Pat. Nos. 4,536,198; 5,297,398; 5,373,704; 5,799,728; 6,364,942; and 6,379,435 disclose examples of other types of moisture-removing apparatus which suffer from one or more of the aforementioned drawbacks and limitations, rendering them non-conducive or undesirable for use with laboratory enclosures.

The apparatus of the prior art typically employ one or more desiccant element housings each of which contains a moisture absorbing material or desiccant to extract the moisture from the air. Prior art air dryer systems generally employ the standard desiccant element housing(s) to perform the drying function. In order to replace the desiccant within a housing, the design of the standard prior art housings often require that nearly all of the housing has to be removed to get access to the desiccant.

The typical prior art desiccant housing design thus presents a number of drawbacks. First, the process of installing the desiccant into the housing is quite cumbersome and often requires a great deal of time. Second, the standard desiccant housings, adapted to use the desiccant contained within disposable bags or canisters, often have to be properly aligned within the housing. Third, removal of such a disposable bags or loose desiccant pellets from the housing is often quite complicated because of the design of the housing.

Accordingly, there is a well-established need for a moisture-removing apparatus or desiccation unit adapted for removing moisture from, and maintaining a dry environment within an enclosure such as laboratory cabinets. In particular, it would be desirable to provide a moisture-removing apparatus or desiccation unit which is compact in design, relatively simple in construction, self-contained, and self-regenerating. Specifically, there is a well established need for a moisture-removing apparatus having a housing which facilitates removal and replacement of desiccant. Furthermore, it would be desirable to provide such a desiccation housing that is highly reliable in operation and lends itself to cost-effective desiccant replacement procedure.

SUMMARY OF THE INVENTION

One aspect of the invention provides a housing assembly for a moisture control apparatus consisting of a housing having first and second sides and first and second panels spaced apart from each other by an interior of the housing and being transverse to the respective sides. A moist gas inlet is provided in the first side of the housing and a dry gas outlet is provided in the first side of the housing in spaced-apart relationship to the moist gas inlet. The desiccant medium is positioned within the housing between the moist gas inlet and the dry gas outlet. A first porous desiccant retention plate and a second porous desiccant retention plate are secured within the housing in spaced-apart relationship to each other. The first and second porous desiccant retention plates define a desiccant chamber therebetween which is adapted for maintaining the desiccant medium. An opening is formed with one of the panels in a location corresponding to the location of the desiccant chamber, so as to facilitate a replacement of the desiccant medium within the desiccant chamber. The housing assembly is also formed with a closure adapted to be received by the opening.

As to another embodiment of the invention, the opening ends extend through the entire width of the respective panel, so as to facilitate replacement of bagged desiccant within the desiccant chamber.

As to a further aspect of the invention, the desiccant medium is situated within a desiccant chamber formed as a unitary cartridge, removable form the housing. The cartridge can be formed by a first porous plate and second porous plate spaced from each other, so that the desiccant medium is situated within the desiccant chamber between the first and second porous plates. The cartridge can be also formed consisting of two additional plates spaced from each other and interconnecting the first and second porous plates. The cartridge can be also formed by four porous plates, so that the desiccant medium is positioned within the space surrounded by the porous plates.

As to still another aspect of the invention, an opening is formed within one of the plates in the location corresponding to the location of the desiccant chamber, so as to facilitate replacement of the cartridge containing the desiccant medium within the housing.

The invention is directed to an apparatus for removing moisture from cabinets or other enclosed spaces, and is particularly adapted for, but not limited to, use in laboratory cabinets. The apparatus has a compact, efficient and self-contained design that facilitates both the thorough drying of air within the cabinet as well as the regeneration of desiccant material used during the drying operation.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to apparatus and method for removing moisture from cabinets or other enclosed spaces. The apparatus incorporates a compact, efficient and self-contained design that facilitates the thorough removal of moisture from air, as well as the regeneration of desiccant material used during such operation.

Figure 1:
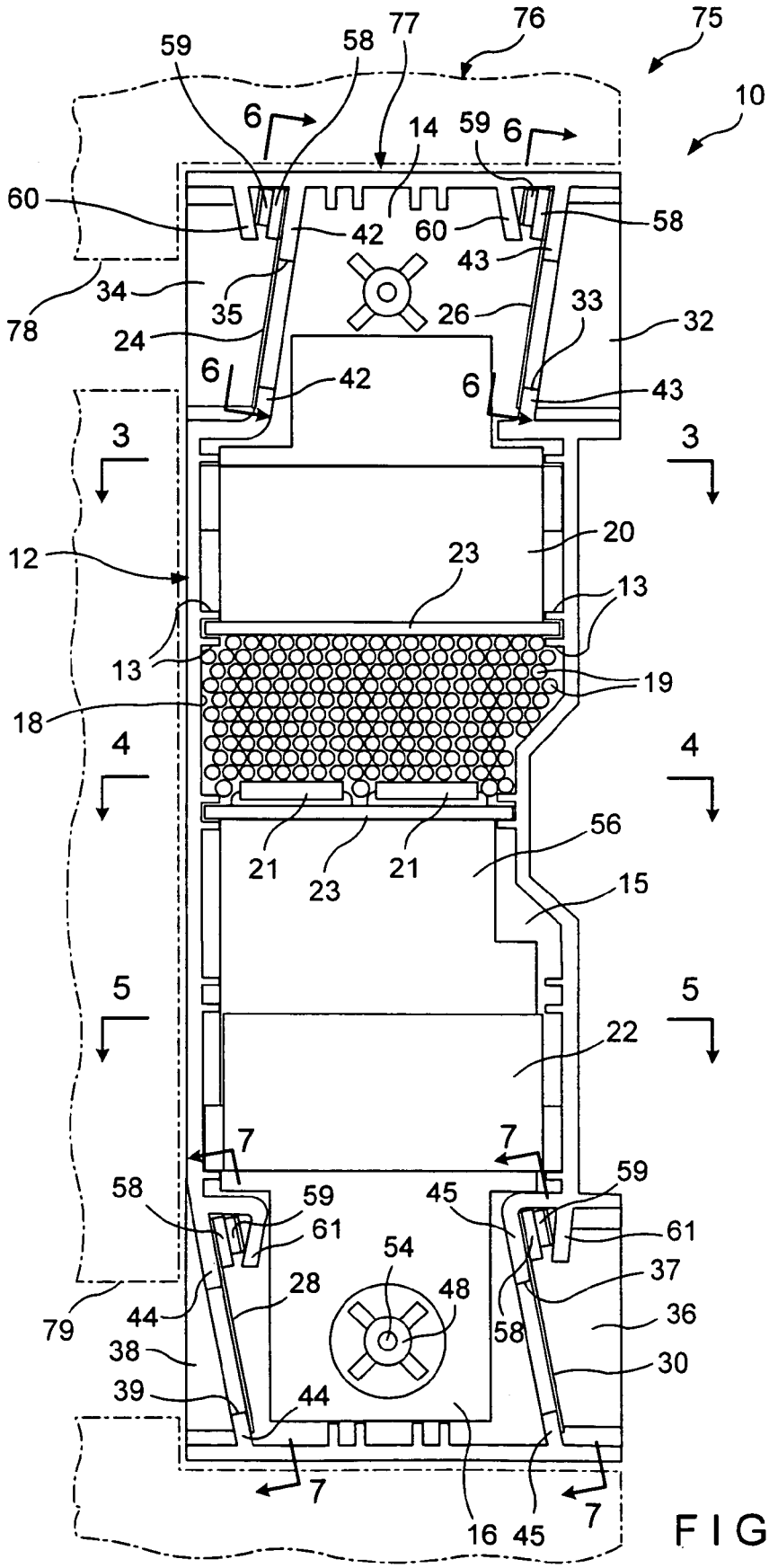
FIG. 1 is a front elevational view of the moisture control apparatus of the present invention, with the front cover removed from the housing of the apparatus to expose interior components of the apparatus.

Referring initially to FIG. 1, a preferred embodiment of the apparatus for moisture control or desiccation unit 10 of the present invention is shown with the front cover 50 (FIG. 2) removed. The desiccation unit 10 includes an elongated housing 12 having an upper region 14, a central region 15 and a lower region 16. A pair of desiccant retention plates 23 provided in the central region 15 in spaced-apart relationship to each other, define therebetween a desiccant chamber 18 that is adapted to receive a desiccant medium 19. A regeneration fan or blower 20 is positioned within the housing 12 between the desiccant chamber 18 and the upper region 14. A drying fan or blower 22 is also situated within the central region 15 of housing 12 between the desiccant chamber 18 and the lower region 16. Desiccant heating elements 21 are provided typically in the vicinity of one of the desiccant retention plates 23, preferably in the lower portion of the desiccant chamber 18. The heating elements 21 are typically low-voltage resistors but may be other heat-generating devices known by those skilled in the art. The upper region 14 is formed with a first inlet area 32 having a first inner flap 26 spaced, by the interior of the housing 12, from a first outlet area 34 having a first outer flap 24. In a similar manner, the lower region 16 is formed with a second outlet area 36 having a second outer flap 30 spaced from a second inlet area 38 having a second inner flap 28. The flaps are preferably constructed from a silicone material, which provides flexibility, good chemical resistance and longevity. Significantly, the flexibility of the silicone flaps provides excellent sealing characteristics during operation of the apparatus. Other possible materials for construction of the flaps include natural rubber and neoprene, in non-exclusive particular.

A microprocessor-based controller, having components (not shown) soldered or otherwise provided on a circuit board 56, is operably associated with the fans 20, 22 and the heating elements 21 for the automatically cycling operation of the fans and the heating elements 21, as hereinafter described.

The moisture control apparatus 10 can be used for removing moisture from an enclosure 75 formed with an outer wall or door 76 provided with an interior cavity 77 having a first opening 78 and a second opening 79. More specifically, the moisture control apparatus or desiccation unit 10 can be used with a desiccation cabinet 75 (shown in phantom) disclosed by applicants' co-pending U.S. patent application Ser. No. 10/075,262, filed Feb. 15, 2002. This desiccation cabinet 75 includes a door 76 formed with an inner cavity 77 having a first opening 78 and a second opening 79 spaced apart from each other and each forming a conduit between the cabinet interior space and the surrounding outside environment. The inner cavity 77 accommodates the desiccation unit 10 in such a manner that the first outlet area 34 is situated in the vicinity of the first opening 78 and the second inlet area 38 is positioned in the vicinity of the second opening 79 in door 76. The first inlet area 32 and the second outlet area 36 of the desiccation unit 10 face the interior of the enclosure or cabinet 75.

Referring now to FIGS. 1–8, the particular structural features and arrangement of the individual components of the desiccation unit 10 will be described in more detail.

Figure 2:
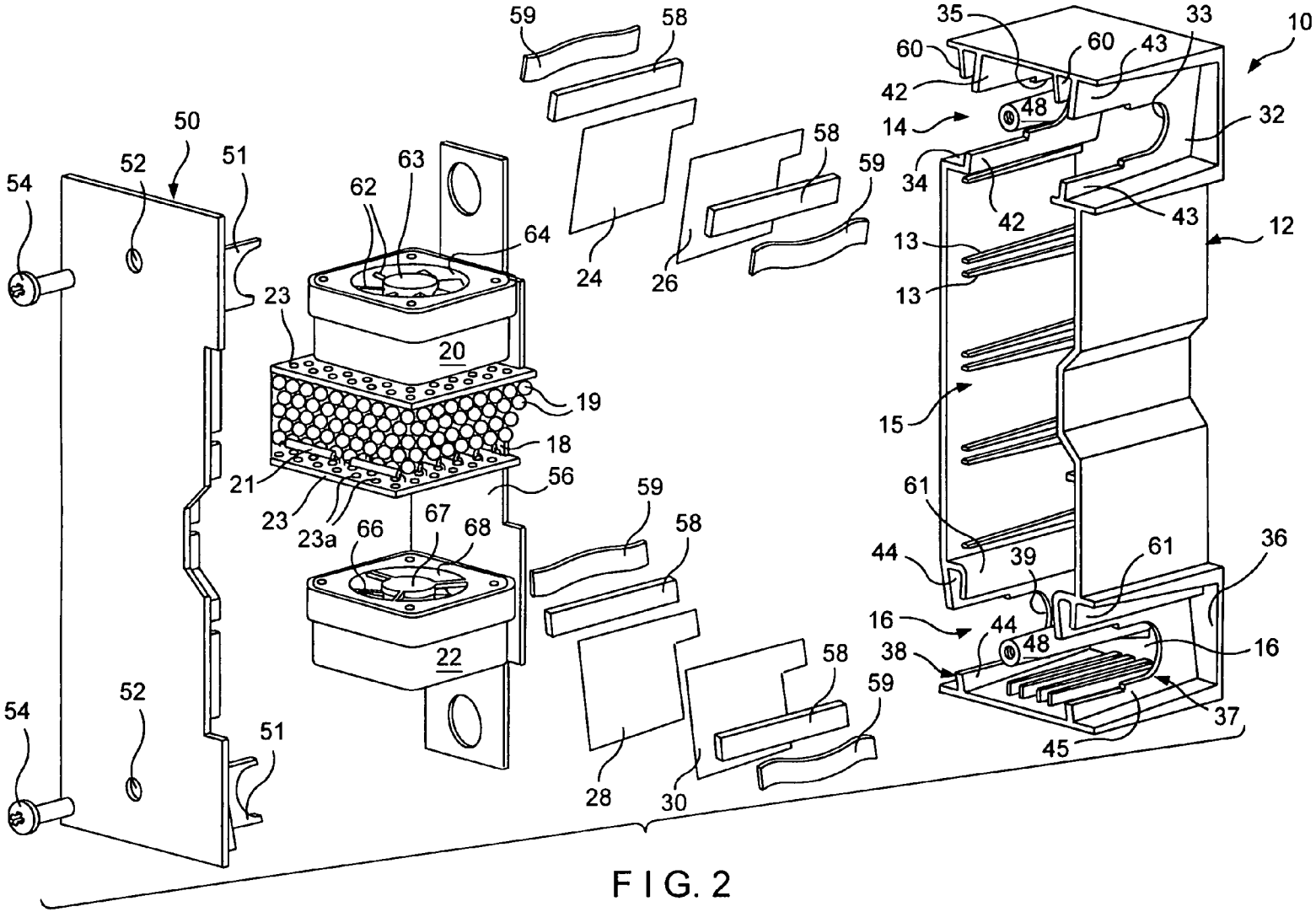
FIG. 2 is an exploded, perspective view of the apparatus.

A front cover 50 can be removably attached to housing 12 so as to enclose the housing interior, including upper region 14, central region 15 and lower region 16. As best shown in FIG. 2, a pair of threaded bosses 48 provided extending from a rear panel of the housing 12 into the upper and lower housing regions, 14 and 16, align with corresponding fastener openings 52 extending through opposite end portions of the front cover 50. Conventional fasteners 54, such as screws, for example, are received through the respective fastener openings 52 and bosses 48 to removably secure the front cover 50 to the housing 12. It is understood that many alternative techniques known by those skilled in the art may be used to form the housing 12 in general and to mount the front cover 50 on the housing 12.

Figure 6:
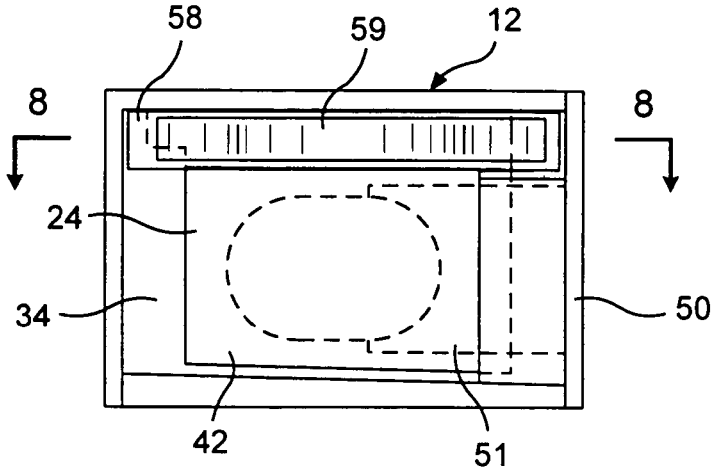
FIG. 6 is a cross-sectional view taken along cutting plane 6—6 in FIG. 1.
Figure 7:
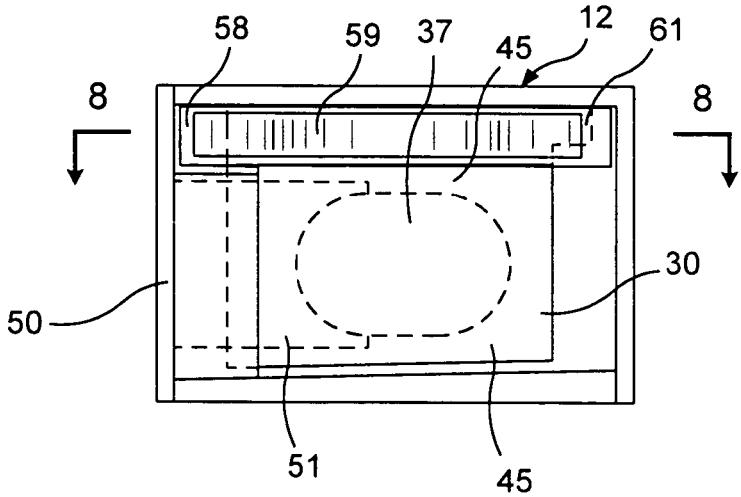
FIG. 7 is a cross-sectional view taken along cutting plane 7—7 in FIG. 1.
Figure 8:
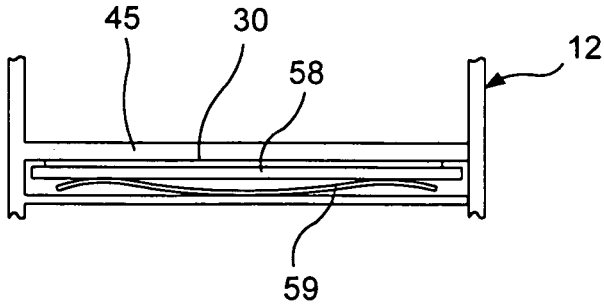
FIG. 8 is a cross-sectional view taken along cutting plane 8—8 in FIGS. 6 and 7, respectively.

A first outlet area sealing flange 42 is provided recessed in the first outlet area 34, and a first inlet area sealing flange 43 is provided recessed in the first inlet area 32. In similar fashion, a second inlet area sealing flange 44 is provided recessed in the second inlet area 38 and a second outlet area sealing flange 45 is provided recessed in the second outlet area 36. Four cover tabs 51, corresponding to the respective sealing flanges 42, 43, 44, and 45 extend from the interior surface of the front cover 50. As best illustrated in FIG. 6, when the front cover 50 is mounted on the housing 12 a first one of the cover tabs 51 engages the first outlet area sealing flange 42 to define an elliptical first outlet opening 35 inside the first outlet area 34. In similar fashion, a second one of the cover tabs 51 engages the first inlet area sealing flange 43 to define an elliptical first inlet opening 33 inside the first inlet area 32. As best illustrated in FIG. 7, a third cover tab 51 extending from the interior surface of the front cover 50 engages the second outlet sealing flange 45 to define an elliptical second outlet opening 37 inside the second outlet area 36. Finally, a fourth cover tab 51 extending from interior surface of the front cover 50 engages the second inlet sealing flange 44 to define an elliptical second inlet opening 39 inside the second inlet area 38.

As shown in FIGS. 1 and 2, a first pair of flap mount flanges 60 extend from the housing 12 into the upper region 14, and a second pair of flap mount flanges 61 extend from the housing 12 into the upper region 14. One of the first pair of flap mount flanges 60 is disposed adjacent to the first outlet area sealing flange 42, whereas the other of the flap mount flanges 60 is disposed adjacent to the first inlet area sealing flange 43. Similarly, one of the second pair of flap mount flanges 61 is disposed adjacent to the second inlet area sealing flange 44, whereas the other of the flap mount flanges 61 is disposed adjacent to the second outlet area sealing flange 45. A flat mount plate 58 and a curved mount plate 59 are sandwiched between each of the first outlet area sealing flange 42 and the corresponding flap mount flange 60, between the first inlet area sealing flange 43 and the corresponding flap mount flange 60, between the second inlet area sealing flange 44 and the corresponding flap mount flange 61, and between the second outlet area sealing flange 45 and the corresponding flap mount flange 61, respectively. The first outer flap 24 is secured between a flat mount plate 58 and the first outlet area sealing flange 42, and the first inner flap 26 is secured between a flat mount plate 58 and the first inlet area sealing flange 43. Likewise, the second inner flap 28 is secured between a flat mount plate 58 and the second inlet area sealing flange 44, and the second outer flap 30 is secured between a flat mount plate 58 and the second outlet area sealing flange 45. Accordingly, as hereinafter described, the first outer flap 24 and the second outer flap 30 are adapted for outward movement into the first outlet area 34 and the second outlet area 36, respectively, to enable the egress of an air flow from the housing 12 in response to a negative pressure gradient from the housing interior to the housing exterior. Conversely, the first inner flap 26 and the second inner flap 28 are adapted for movement into the housing interior to enable the ingress of an air flow into the housing 12 in response to a positive pressure gradient from the housing interior to the housing exterior.

Figure 3:
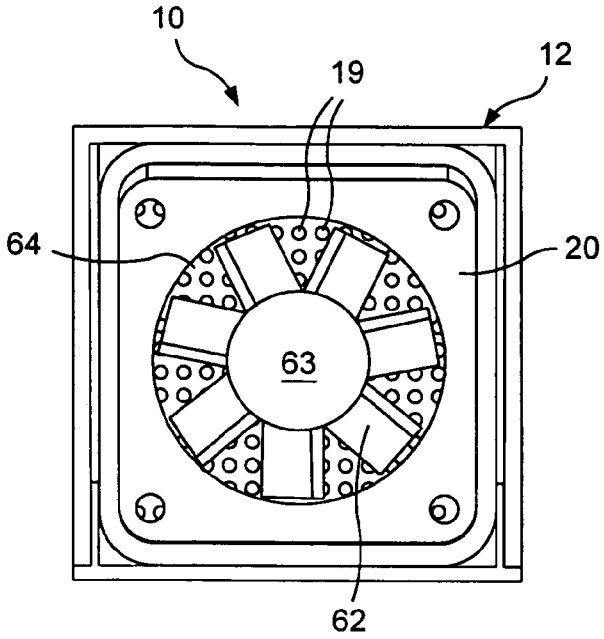
FIG. 3 is a cross-sectional view taken along cutting plane 3—3 in FIG. 1.
Figure 4:
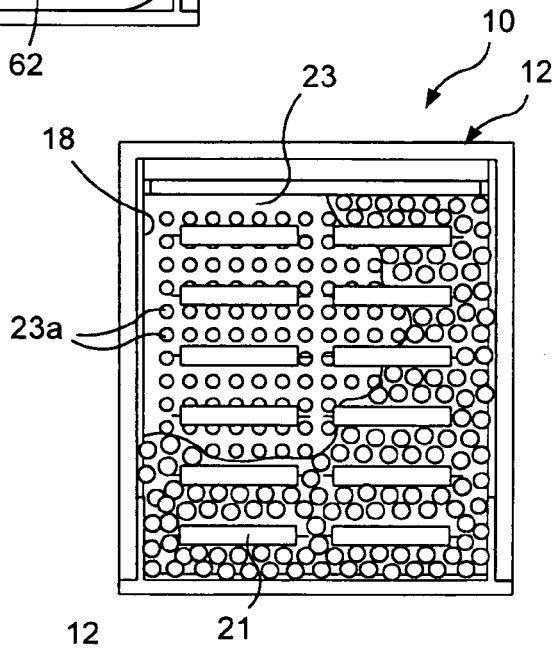
FIG. 4 is a cross-sectional view taken along cutting plane 4—4 in FIG. 1, with the heating elements positioned below the desiccant chamber.
Figure 5:
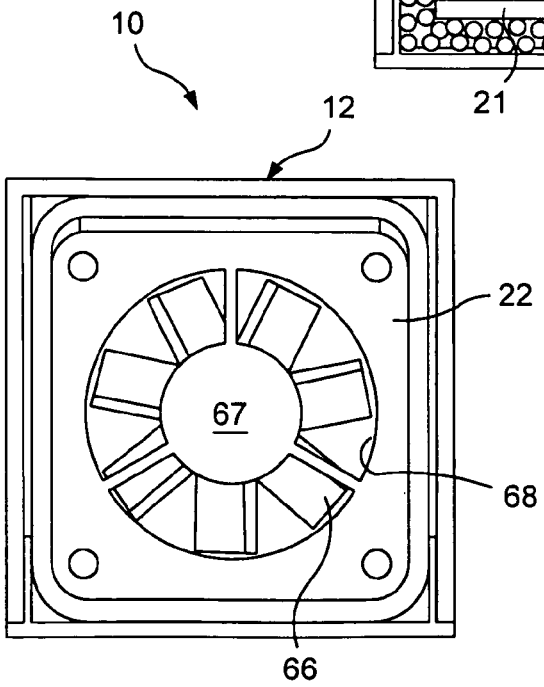
FIG. 5 is a cross-sectional view taken along cutting plane 5—5 in FIG. 1.

As shown in FIG. 2, regeneration fan 20 and drying fan 22 may be mounted in a spaced-apart relationship to each other. In one embodiment of the invention the fans are mounted on the elongated circuit board 56. However, other mounting arrangements are contemplated. As shown in FIG. 3, the regeneration fan 20 typically includes multiple fan blades 62 extending from a central hub 63 and rotating within a fan opening 64. Likewise, as best shown in FIG. 5, the drying fan 22 typically includes multiple fan blades 66 extending from a central hub 67 and rotating within a fan opening 68.

The desiccant retention plates 23 are also preferably inserted between pairs of adjacent housing ridges 13 extending into central region 15. Preferably, a first one of the desiccant retention plates 23 is disposed adjacent to or against the upstream end of the regeneration fan 20, and the other desiccant retention plate 23 is spaced from the first desiccant retention plate 23 toward the upstream end of the drying fan 22. Each of the desiccant retention plates 23 is provided having a porous design with a plurality of apertures 23*a* to facilitate the flow of air therethrough. The desiccant medium 19 is maintained within the desiccant chamber 18 between the desiccant retention plates 23. Preferably, the desiccant medium is comprised of silica gel in the form of beads or pellets, which we have found to enable optimal air flow through the desiccation chamber. The pellet size should be larger than the diameter of apertures 23*a* of the porous retention plates 23. In this manner, the porous retention plates 23 will trap any loose desiccants as well as other airborne particles having dimensions exceeding the size of the apertures. The chamber 18 may also contain a mixture of the pellet size desiccant with small pieces of charcoal capable of absorbing low energy radioactive components. In an alternative embodiment of the invention (see FIG. 14), the desiccant can be in the form of single or multiple bags of desiccant 82, adapted for positioning within the desiccant chamber 18. Similar to the above, the bags of desiccant, in addition to the desiccant elements, can also contain elements of charcoal. However, it will be apparent to those skilled in the art that alternative desiccant mediums are possible, including porous aluminum oxide, montmorillonite clay, silica gel, molecular sieve (synthetic zeolite), calcium sulfate and calcium oxide, to name just a few. Preferably, the silica gel desiccant medium 19 should be replaced about every 3–4 years.

Figure 13:
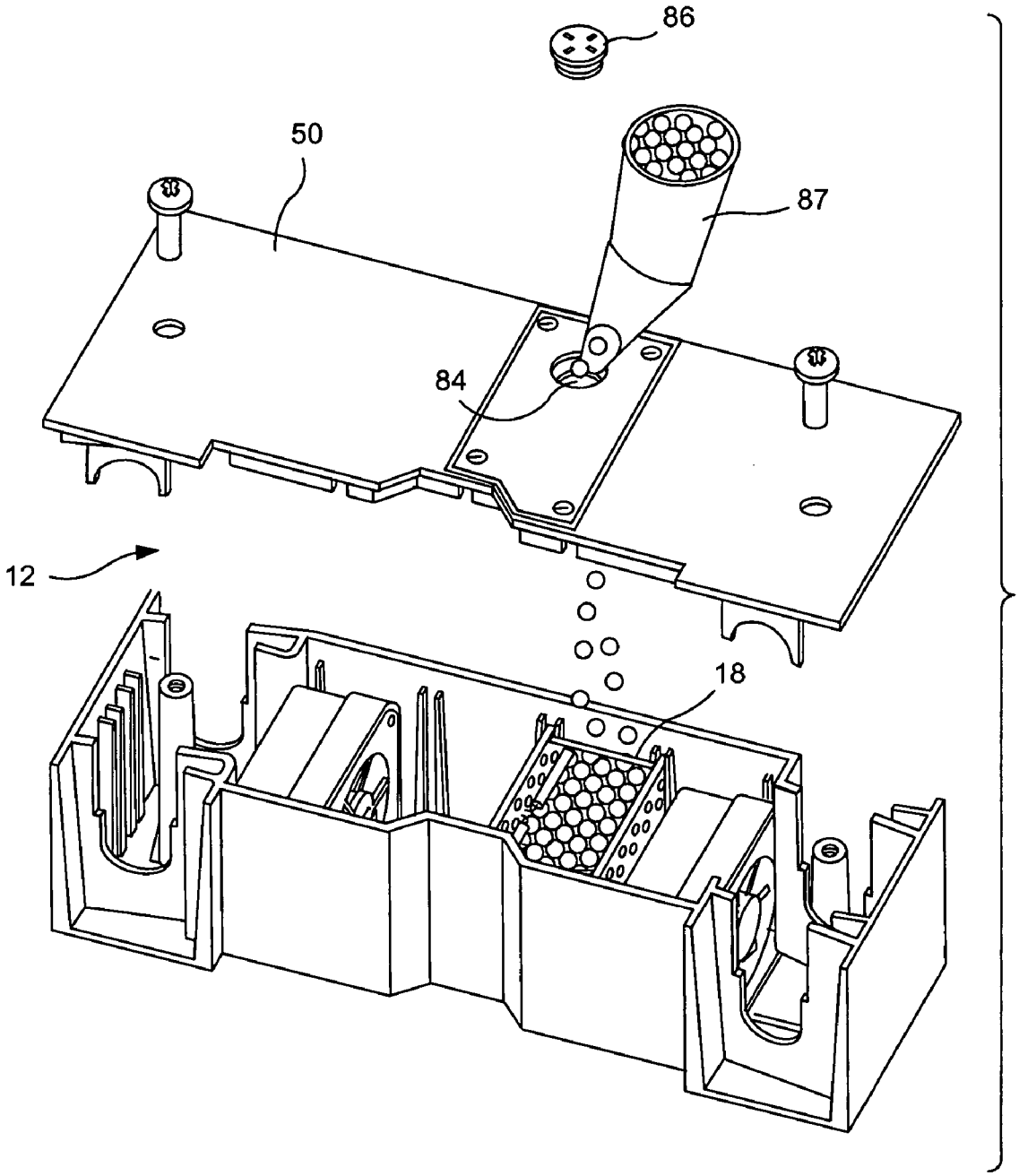
FIG. 13 is an exploded perspective view showing another embodiment of the moisture control apparatus of the invention.

As illustrated in FIG. 13, a central region of the front cover 50 of the housing assembly 12 can be formed with an opening 84 having a location corresponding to the location of the desiccant chamber 18. A semi-resilient closure or plug 86 is provided for close engagement with the opening 84. Although a semi-circular configuration of the opening 84 is illustrated, it should be understood that any suitable configuration of the opening 84 and closure 86 is within the scope of the invention.

Figure 14:
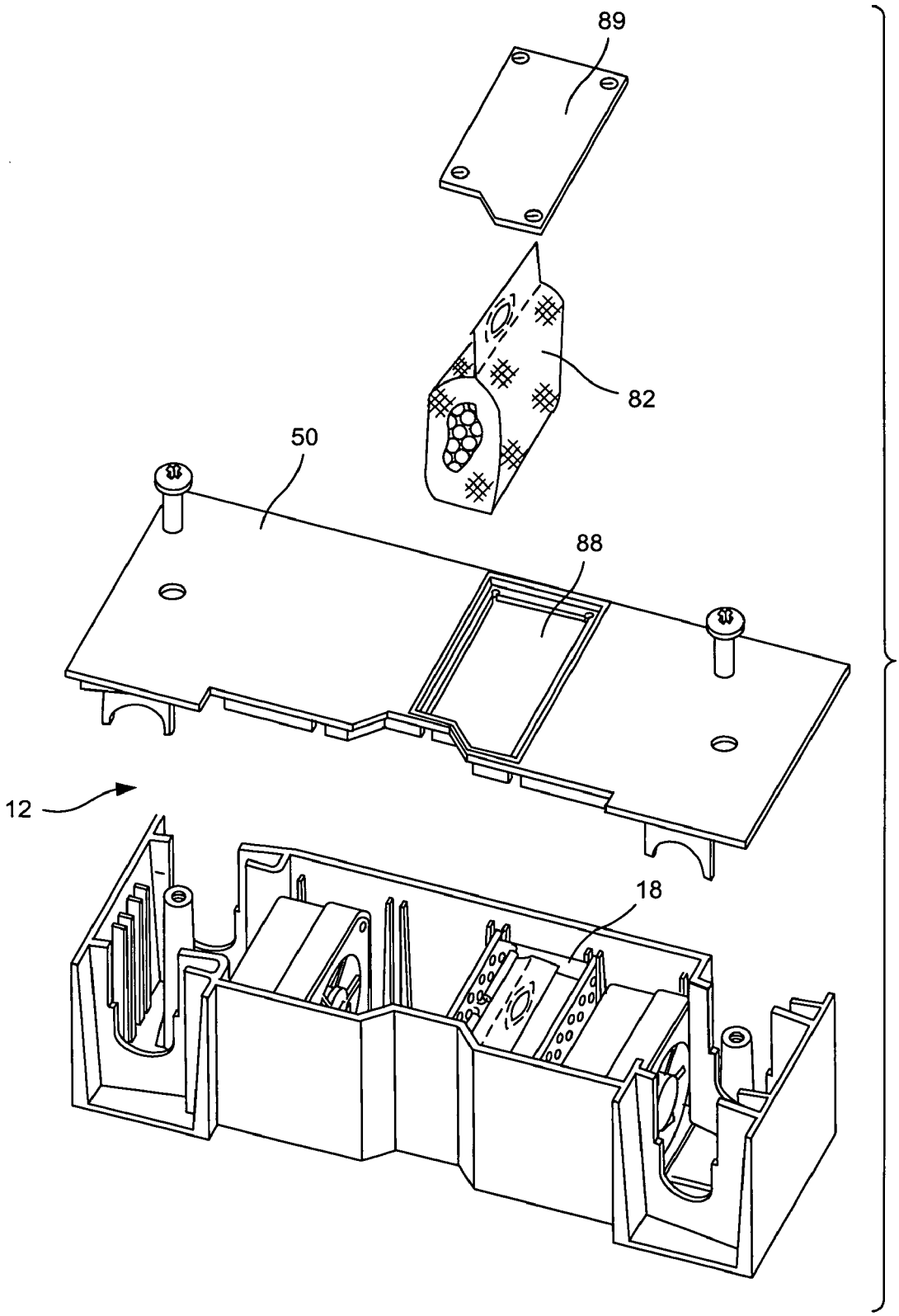
FIG. 14 is an exploded, perspective view of the apparatus showing a further embodiment of the invention.

In a further embodiment of the invention, as illustrated in FIG. 14, the front cover 50 is formed with cut out 88 occupying the entire central area thereof in a manner so as to correspond to the location of the desiccant chamber 18. The closure 89 is adapted for close engagement with the opening 88.

In the embodiment of FIG. 13, replacement of the loose desiccant pellets would require removal of the housing assembly 12 from the apparatus. Then, an operator has to remove the semi-flexible closure 86 from the front cover 50 so as to expose an opening 84 enabling the disposal of the loose desiccant in an orderly fashion. Upon fresh loose desiccant being positioned into the desiccant chamber 18 through the opening 84 by means of a disposable arrangement 87, it is closed by the closure 86. The housing assembly should then be reconnected to the apparatus. Such reconnection requires proper reorientation of the housing assembly 12 within the apparatus.

When the desiccant is in the form of a bag of desiccant 82 and the arrangement illustrated in FIG. 14 is utilized, replacement of such bag often requires only removal of the cover portion 89. In this instance, an operator would need only to pull out the used bag of desiccant through the opening 88 from the exposed desiccant chamber 18 and to insert the fresh bag of desiccant. Then, the cover portion 89 is reconnected to the opening 88. In this embodiment, it is often unnecessary for the housing assembly 12 to be removed form the apparatus. Thus, there is no need for the complicated realignment and reconnection of the housing assembly within the desiccant apparatus. Such laborious realignment and reconnection are typical in prior art desiccant housings adapted to accommodate desiccant bags.

Figure 15:
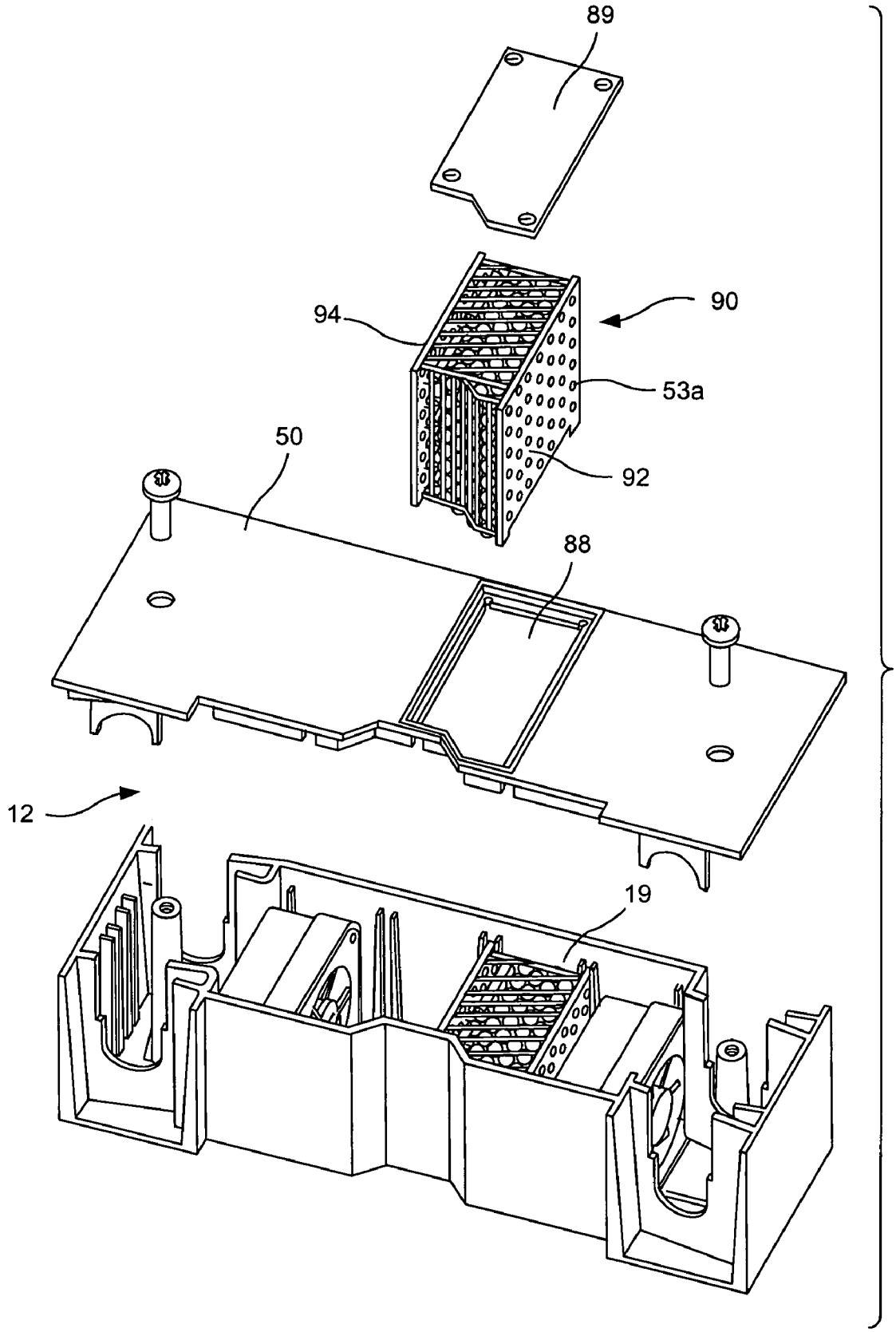
FIG. 15 is an exploded, perspective view showing still further embodiment of the apparatus of the invention.

In a further embodiment of the invention illustrated in FIG. 15, the desiccant chamber 19 is in the form of a removable cartridge 90. In the preferred modification, the cartridge 90 is formed with at least front and back porous walls 92 and 94 having a plurality of openings similar to that of the previously described openings 53*a*. As illustrated in FIG. 15, the cartridge 90 the inner space is formed between the porous walls 92 and 94. In this manner, the walls are spaced from each other by a plurality of transverse members interconnecting the porous walls at corner regions thereof. Other walls of the cartridge 90 are formed by a plurality of rods separated from each other by gaps. The size of such gaps should be smaller than the respective size of the desiccant pellets or charcoal elements positioned inside of the cartridge 90. However, it should be noted that an embodiment of the removable cartridge having all walls formed from the porous material is within the scope of the invention. Such cartridge 90 is adapted to accommodate either loose palletized desiccant or bags of desiccant as discussed hereinabove. Upon positioning of the cartridge 90 into the housing so as to form the desiccant chamber 19, one porous wall is disposed against the upstream end of the regeneration fan 20, and the other porous wall is positioned toward the upstream end of the drying fan 22. In order to achieve replacement of the cartridge with the loose or bagged desiccant positioned thereinside, only the cover portion 89 has to be removed. Then, the cartridge 90 containing the used desiccant is removed and another cartridge with fresh desiccant is inserted into the apparatus and the cover portion 89 is reconnected. During the insertion and removal of the cartridge, the pairs of adjacent housing ridges 13 can be utilized. Compared to the prior art housings, the invention as disclosed hereinabove, allows easy access to and removal of the desiccant from the apparatus.

In a preferred embodiment of the present invention, the desiccation unit 10 is disposed in a vertical orientation during operation, with the desiccant heating elements 21 provided in the vicinity of an upper surface of a lower one of the desiccant retention plates 23 and beneath the desiccant medium 19. However, the desiccation unit 10 is alternatively suited for operation in a horizontal orientation. In this manner, the desiccation unit is particularly suited for use with enclosures or storage cabinets adapted for being supported on a support surface in both vertical and horizontal orientations. One of the examples of such enclosures is the modular laboratory cabinet described in applicants' aforementioned co-pending application.

The electronic components of the circuit board 56 include a microprocessor (not shown) operably connected to the regeneration fan 20, the drying fan 22 and the heating elements 21 for control thereof. Additionally, the microprocessor controls a terminal switch provided as a safety feature. More specifically, the terminal switch is provided for automatically shutting off the unit 10 in the event that overheating of any of the components, or the unit generally, is detected. The terminal switch is designed to reset itself upon determining that the overheating condition is no longer present. As an optional feature, a slow light emitting diode (LED) may be provided for indicating when the power is on.

Figure 9:
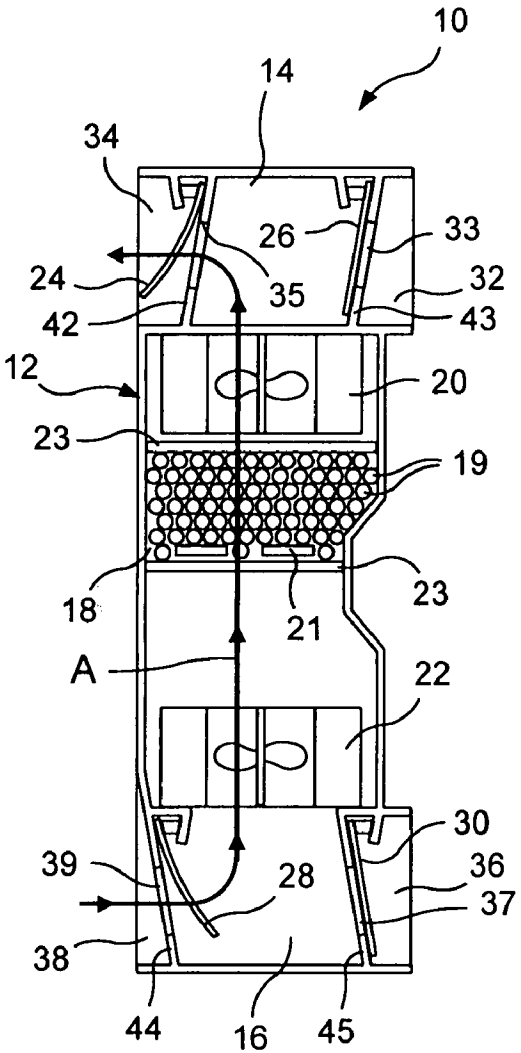
FIG. 9 illustrates the unit of the invention (having the heating elements positioned at a bottom part of the desiccant chamber) during the desiccant medium regeneration step.

Referring primarily to FIG. 9, the operation of the desiccation unit 10 of the present invention will now be described in more detail. In a first operational step, the desiccation unit 10 is activated for drying, regenerating or otherwise reactivating desiccant medium 19 contained within the desiccant chamber 18. In the preferred embodiment, the desiccant regeneration step is performed over a period of about four minutes. During this time, the drying fan 22 remains idle, while the heating elements 21 and the regeneration fan 20 are actuated, so as to generate a stream of gas or ambient air within the housing 12 in the direction of arrow A, as indicated in FIG. 9 by the solid line. The air flow produced by the regeneration fan 20 is caused by a positive air pressure zone that is induced by the fan 20 in the upper region 14 and a lower air pressure, or partial vacuum zone that is induced by the fan 20 in the central region 15 and in the lower region 16 of the desiccation unit 10. The air stream enters the housing 12 through the second inlet area 38 having the second inner flap 28. Accordingly, the incoming air forcibly disengages the second inner flap 28 from the second inlet sealing flange 44, and the outgoing air of the air stream forcibly disengages the first outer flap 24 from the first outlet sealing flange 42. As it traverses the interior of the housing 12, the air stream flows through the idle drying fan 22 and, after being heated by the heating elements 21, passes through the desiccant medium 19 situated within the desiccant chamber 18. In the chamber 18, the desiccant medium 19 is heated by the heating elements 21 so that the vapor pressure of the desiccant medium 19 becomes higher than that of the heated reactivation air. Moisture is thereby transferred from the desiccant medium 19 to the heated reactivation air passing therethrough. The heated air stream, having a relatively high moisture content, then exits the housing 12 through the first open flap 24 of the first outlet area 34. Accordingly, the hot, moist reactivation air produced in the first operational step is discharged outside the housing 12 through the first outlet area 34 and the first door opening 78 (FIG. 1) of the desiccation cabinet 75. The desiccant medium 19 should be substantially dry at the end of the first operational step prior to commencing the second operational step, or drying of air inside the cabinet 75. After the desiccant medium 19 has been sufficiently dried, it is allowed to cool and can again dry a second air stream passing from the interior of the cabinet 75 through the housing 12 in the opposite direction, as hereinafter described.

To facilitate the air flow extending in the direction of the arrow A, in the first operational step heretofore described, the second inner flap 28 is opened by extending inwardly into the interior space of the housing 12 from the second inlet area 38 to open the second inlet opening 39, whereas the first outer flap 24 is opened by outwardly extending from the first outlet area 34 to open the first outlet opening 35. In this condition, the high air pressure zone produced by the re-generation fan 20 in the upper region 14 is applied against the inwardly-positioned inner flap 26, so as to press it against the first inlet sealing flange 43 and thereby seal the first inlet opening 33. Moreover, the lower air pressure zone produced by the fan 20 in the central region 15 and the lower region 16 creates suction which draws the second outer flap 30 against the second outlet sealing flange 45 and thereby seals the second outlet opening 37. Thus, during the regeneration mode, the arrangement of the outer and inner flaps provides the flow of ambient air through the interior of the housing 12 in general, and through the desiccation chamber 18 specifically, while blocking the fluid communications, or air flow, between the interior of the enclosure or desiccation cabinet and the interior of the desiccant unit housing 12.

In the preferred embodiment of the invention, the fan 20 is actuated for about one minute. In a second operational step, the heating elements 21 are turned off and the regenerating fan 20 is actuated for a short period of time, so as to continue discharging of the moist hot air developed in the first step from the housing 12. During the second step, the flaps 24, 26, 28, 30 are positioned as heretofore described with respect to the first step. The flow of dry air produced by the fan 20 is sufficient to substantially remove any remaining moisture that was previously accumulated in the desiccant medium 19 and in other areas in the interior of the housing 12. Thus, the desiccant medium 19 is regenerated by continuously flowing the moisturized air through the exhaust outlet 34 and the first opening 78 of the cabinet door 76, to the atmosphere.

Figure 10:
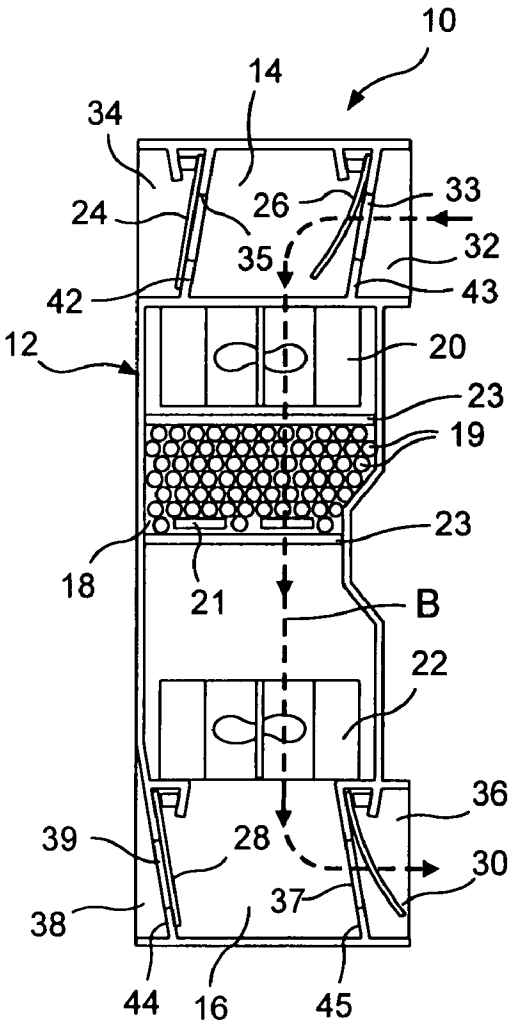
FIG. 10 shows the unit of the invention (having the heating elements positioned at the bottom part of the desiccant chamber) during the drying mode to control humidity within the enclosed desiccation chamber.

Referring now to FIG. 10, after the desiccant medium 19 is dried or re-generated in the manner heretofore described with respect to FIG. 9, the desiccation unit 10 is operated in a third operational step, or drying mode, in order to create and maintain a low humidity level within an enclosed desiccation space such as, for example, the cabinet 75 shown in phantom in FIG. 1. In this operational step, the desiccant heating elements 21 are turned off, the regeneration fan 20 is idle and the drying fan 22 is actuated, so as to generate a stream of gas or ambient air passing through the interior of the housing 12 in the direction identified by the arrow B, shown in FIG. 10 by the dashed lines. Accordingly, a stream of moisture-containing air from the interior space of the desiccation space or cabinet 75 enters the desiccation unit 10 through the first inlet area 32, and flows through the idle regeneration fan 20. The drying fan 22 forces the moisture-filled air through the desiccant medium 19 contained within the desiccation chamber 18. Because it is relatively cool and dry, the desiccant medium 19 has a lower surface vapor pressure than that of the moist air flowing through the desiccation chamber 18 and, therefore, attracts moisture from the passing air stream. Ultimately, as it attracts moisture from the air, the desiccant medium 19 becomes moisturized and rises in temperature due to the release of heat from the moisture of the air stream being dried. At some point, the desiccant medium 19 becomes sufficiently moisturized and its temperature rises to the point at which a vapor pressure equilibrium is reached between the desiccant medium 19 and the flowing air. Consequently, the surface vapor pressure of the medium 19 is no longer sufficiently lower than the vapor pressure of the ambient air to facilitate continued transference of moisture from the flowing air to the medium 19. At that point, the desiccant medium 19 will no longer attract moisture from the air and requires drying or reactivation, in the same manner as heretofore described with respect to the first operational step of FIG. 9, prior to reuse.

After it flows through the desiccation chamber 18, the central region 15 and the lower region 16, respectively, of the housing 12, the air stream exits the unit 10 through the second outer flap 30 of the second outlet area 36 and enters the interior space of the desiccation cabinet 75. The ingress of the moist air from the cabinet 75 into the housing 12 and through the desiccation chamber 18, and the egress of the dried air from of the housing 12 back into the cabinet 75, is induced by a high pressure zone created by the fan 22 in the lower region 16 relative to a lower pressure zone, or partial vacuum, created by the drying fan or blower 22 in the central region 15 and the upper region 14.

Thus, during the third operational step, the stream of air enters the desiccation unit 10 through the first inlet area 32 in general and, in particular, through the first inlet opening 33 exposed by the inwardly open first inner flap 26. After traversing the desiccation chamber 18 and the remainder of the interior of the housing 12, the air stream exits the unit through the second outlet opening 37 exposed by the outwardly open second outer flap 30 of the second outlet area 36.

In the drying mode of the third operational step, heretofore described with respect to FIG. 10, to facilitate passage of the air stream as indicated by the arrow B through the interior of the housing 12, the first inner flap 26 extends inwardly within the upper region 14 to disengage the first inlet sealing flange 43 and expose the first inlet opening 33. The second outer flap 30 extends outwardly within the second outlet area 36 to disengage the second outlet sealing flange 45 and expose the second outlet opening 37. Due to the suction resulting from the lower pressure zone or partial vacuum formed within the upper region 14, the first outer flap 24 is sucked against the first outlet sealing flange 42 to seal the first outlet opening 35. Furthermore, the positive pressure zone in the lower region 16 forces the second inner flap 28 outwardly against the second inlet sealing flange 44 to seal the second inlet opening 39. In view of the above, during the drying mode the flaps are arranged so as to establish fluid communication or air flow between the interior of the enclosure or desiccation cabinet 75 and the interior of the housing 12. On the other hand, the air flow between the outside environment and the interior of the housing 12, as indicated by the arrow A in FIG. 9, is blocked by the closed first outer flap 24 and second inner flap 28.

During a fourth operational step, the desiccation unit 10 is operated in a pre-heating mode. In this condition, the regeneration fan 20 and the drying fan 22 are idled and only the heating elements 21 are actuated. In this mode, the desiccant medium 19 is pre-heated for about one minute prior to initiation of the reactivation mode described with respect to the first operational step of FIG. 9.

Figure 12:
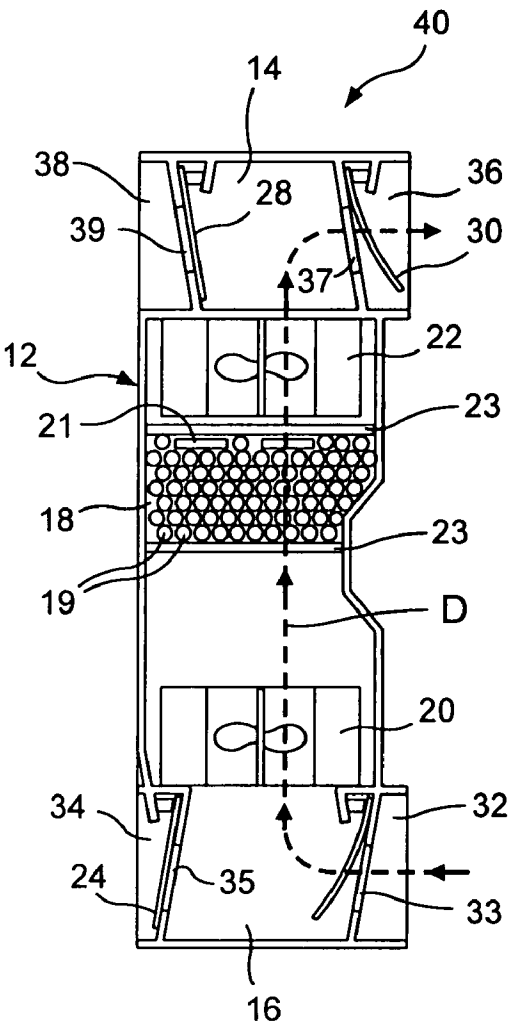
FIG. 12 is similar to FIG. 10 but reflects positioning of the heating elements at the top part of the desiccant chamber.
Figure 11:
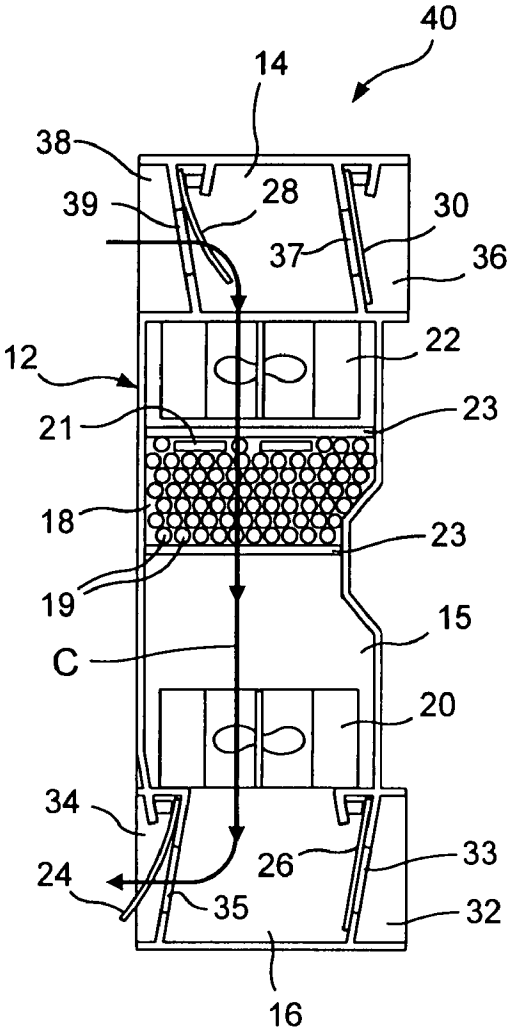
FIG. 11 is similar to FIG. 9 but reflects positioning of the heating elements at a top part of the desiccant chamber.

As described hereinabove, in the preferred embodiment of the present invention the heating elements 21 are positioned underneath or below the level of desiccant medium 19, as in the desiccation unit 10 shown in FIG. 9. One reason for such location is a natural upward flow of heated air. Thus, when the heating elements 21 are activated, the heated air in the reactivation mode moves upwardly within the unit 10, and particularly, through the desiccant chamber 18, to dry the desiccant medium 19. This is the most efficient air flow configuration for drying the medium 19. Obviously, the unit 10 will also function when the heating elements 21 are located above the desiccant medium 19, as in the desiccation unit 40 shown in FIG. 11 of the drawings. In that case, the regeneration fan 20 is positioned beneath the desiccant chamber 18 for drawing a stream of regenerating air (as indicated in FIG. 11 by the solid line "C") downwardly through the interior of the housing 12 and the desiccant chamber 18. In the drying mode, shown in FIG. 12, the drying fan 22 of the desiccation unit 40 draws a stream of moist air, designated by the dashed line "D", upwardly through the interior of the housing 12 and the desiccant chamber 18. In this air flow configuration, the flow of air generated by the fans 20, 22 should preferably be much greater.

As previously described hereinabove, the unit 10 is functional in various orientations. However, a vertical orientation is preferred since such an orientation facilitates the natural rising of heat, generated by the heating elements beneath the desiccant compartment, through the desiccant medium. In other words, in the horizontal orientation there is a partial utilization of the natural upward heat flow, such that the heated air from the heating elements positioned at the bottom still rises. However, the upper heating elements are not as efficient when the unit 10 is in a horizontal orientation vis-à-vis the preferred vertical orientation. Nevertheless, it is should be understood that the unit functions in the horizontal orientation to provides adequate heating and regeneration of the desiccant medium.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A housing assembly for a moisture control apparatus, comprising:

a housing having first and second sides and first and second panels spaced apart from each other by an interior of the housing and traverse to said sides;

a moist gas inlet provided in the first side of said housing;

a dry gas outlet provided in the first side of said housing in spaced-apart relationship to said moist gas inlet;

a desiccant medium provided in said housing between said moist gas inlet and said dry gas outlet;

a first porous desiccant retention plate secured within said housing;

a second porous desiccant retention plate secured within said housing in spaced apart relationship to said first desiccant retention plate;

said first and second porous desiccant retention plates define a desiccant chamber therebetween for maintaining said desiccant medium; and a drying fan provided in said housing for generating a flow of a moist gas through said moist gas inlet, into said housing, through said first and second porous retention plates and said desiccant medium situated in the desiccant chamber, so as to be discharged from said housing through said dry gas outlet; and an arrangement for reactivating said desiccant medium comprising a regeneration gas inlet provided in the second side of said housing spaced from said first side by an interior of the housing, a regeneration gas outlet provided in the second side of said housing in spaced-apart relationship to said regeneration gas inlet, and a regeneration fan provided in said housing between said regeneration gas inlet and said regeneration gas outlet.

2. The housing assembly as claimed in claim 1, further comprising an opening formed within one of said panels in a location corresponding to a location of said desiccant chamber, so as to facilitate replacement of said desiccant medium within said desiccant chamber.

3. The housing assembly as recited in claim 2, further comprising a closure adapted to be received by said opening.

4. The housing assembly as claimed in claim 3, wherein said opening extends through the entire width of said respective plate, so as to facilitate replacement of bagged desiccant within said desiccant chamber.

5. A housing assembly for a moisture control apparatus, comprising:

a housing having at least first and second sides and first and second panels spaced apart from each other by an interior of the housing and transverse to said sides;

a moist gas inlet provided in the first side of the housing;

a dry gas outlet provided in the first side of said housing in a spaced-apart relationship to said moist gas inlet;

a desiccant medium provided in said housing between said moist gas inlet and said dry gas outlet;

said desiccant medium being situated in a desiccant chamber formed as a unitary cartridge removable from said housing; and a drying fan provided in said housing for generating a flow of a moist gas into said housing through said unitary cartridge situated in the desiccant chamber, so as to be discharged from said housing through said dry gas outlet; an arrangement for reactivating said desiccant medium comprising a regeneration gas inlet provided in the second side of said housing space from said first side by an interior of the housing, a regeneration gas outlet provided in the second said of said housing in spaced-apart relationship to said regeneration gas inlet, and a regeneration fan provided in said housing between said regeneration gas inlet and said regeneration gas outlet.

6. The housing assembly as recited in claim 5, wherein said cartridge is formed by at least a first porous plate and a second porous plate spaced from each other, so that said desiccant medium is situated in said desiccant chamber between said first and second porous plates.

7. The housing assembly as recited in claim 6, wherein said cartridge further comprises two additional plates spaced from each other and interconnecting said first and second porous plates.

8. The housing assembly as recited in claim 7, further comprising an opening formed with one of said plates in a location corresponding to a location of said desiccant chamber, so as to facilitate replacement of said cartridge containing the desiccant medium within said housing.

9. The housing assembly as recited in claim 8, further comprising a closure adapted to be received by said opening.

10. The housing assembly as recited in claim 9, wherein said opening extends through the entire width of said respective plate.

11. The housing assembly as recited in claim 9, wherein said opening occupies the partial width of said respective plate.

12. The housing as recited in claim 7, wherein said cartridge is formed by four porous plates, so that said desiccant medium is positioned within the space surrounded by the porous plates.

* * * * *